US005266168A

United States Patent [19]

Suica

[11] Patent Number: 5,266,168

[45] Date of Patent: Nov. 30, 1993

[54] GRAVITY TYPE PULP WASHER OR THICKENER WITH ROTATING DISRUPTERS

[75] Inventor: David E. Suica, Cincinnati, Ohio

[73] Assignee: The Black Clawson Company, Middletown, Ohio

[21] Appl. No.: 813,899

[22] Filed: Dec. 20, 1991

[51] Int. Cl.[5] ..... D21C 9/06

[52] U.S. Cl. ..... 162/314; 162/60; 162/311; 68/181 R; 210/402

[58] Field of Search ..... 162/60, 276, 281, 311-314, 162/321, 323-329; 68/181 R, 182; 210/402

[56] References Cited

U.S. PATENT DOCUMENTS

| | | | |
|---|---|---|---|
| 847,857 | 3/1907 | Walker et al. | 162/325 |
| 1,693,560 | 11/1928 | Haskell et al. . | |
| 1,746,708 | 2/1930 | Mansfield . | |
| 1,877,030 | 9/1932 | O'Connor | 210/402 |
| 2,141,273 | 12/1938 | Kutter | 92/43 |
| 2,669,909 | 2/1954 | Gibson | 92/42 |
| 3,065,787 | 11/1962 | Rescheneder | 162/327 |
| 3,190,792 | 6/1965 | Beachler et al. | 162/264 |
| 3,772,144 | 11/1973 | Luthi et al. | 162/110 |
| 3,874,998 | 4/1975 | Johnson | 162/352 |
| 4,491,501 | 1/1985 | Klein | 162/60 |
| 4,827,741 | 5/1989 | Luthi | 68/43 |

FOREIGN PATENT DOCUMENTS

| | | | |
|---|---|---|---|
| 144249 | 1/1936 | Austria | 162/327 |
| 79/00765 | 10/1979 | PCT Int'l Appl. | 210/402 |
| 9115629 | 10/1991 | PCT Int'l Appl. . | |
| 534859 | 3/1941 | United Kingdom | 162/327 |

*Primary Examiner*—Karen M. Hastings
*Attorney, Agent, or Firm*—Biebel & French

[57] ABSTRACT

A cylinder type paper pulp washer or thickener apparatus includes a rotatable cylinder mold with a forming wire surface. The mold rotates at least partially submerged in a vat of dilute paper pulp stock and a differential pressure across the wire surface draws stock from the vat through the cylinder mold and forms a pulp mat on the wire surface, and a plurality of disrupters are positioned within the vat and in arcuately spaced relation to the wire surface to cause a disruption of the fiber mat which obstructs the flow of the stock liquid through the wire surface and thereby provides for the reestablishment of flow. Various disrupters are shown, including a rotating non-circular bar, a doctor blade, a foil, a fluid jet, a brush, and a triangular protuberance. A plurality of such disrupters are positioned in peripherally spaced relation to cause repeated disruption and reformation of a fiber mat to increase the throughflow and washing or thickening efficiency of the apparatus.

1 Claim, 4 Drawing Sheets

GRAVITY TYPE PULP WASHER OR THICKENER WITH ROTATING DISRUPTERS

BACKGROUND OF THE INVENTION

This invention relates to the washing and/or thickening of pulp and more particularly to method and apparatus for the improvement of the efficiency of a vat-type thickener or washer in which a cylinder mold rotates in at least partially submerged condition in a pool or vat of dilute paper stock.

Machines of this general type are cylindrical screens which are quite similar to the cylinder molds which have been used for many years in the making of paper. The circumferential area of the cylinder screen or forming wire is a reticulated surface through which water is drawn from a dilute pool of paper stock in the vat, thereby depositing a layer of fibers on the forming wire as the cylinder mold is rotated. Suction is usually applied to the liquid from the interior of the cylinder mold so as to create a differential head across the mold and draw the stock toward the forming wire. White water is extracted from the fibers as they are deposited on the wire. These are sometimes referred to as "gravity" thickeners or washers due to the fact that gravitational forces causes the liquid in the vat to flow into and through the screen.

The apparatus may be used as an extraction device, to thicken the stock, or may be used primarily for washing of the fibers. When such apparatus is used to make paper, the layer of fibers deposited on the forming wire is removed from the cylinder mold at an area or region which is outside or above the pool of stock in which the cylinder mold is partially submerged. The removal of the layer of fibers from the cylinder mold is accomplished by transferring the layer to a felt traveling substantially tangentially to the mold. However, in thickening or washing, the fiber mat is usually disrupted or broken up and removed in bulk.

The gravity type washer or thickener offers the advantage of a simplified structure and relatively low cost. Examples are shown in Gibson, U.S. Pat. No. 2,669,909 issued Feb. 23, 1954 and Haskell et al, U.S. Pat. No. 1,693,560 issued Nov. 27, 1928. In recent years, more sophisticated systems have been designed in which a the cylinder screen is fully enclosed within the vat. Also, the vat may be closed as to be fully air tight so as to completely enclose the rotating mold. Examples of washers with substantially or completely enclosing vats operating by a differential pressure across the cylinder screen are shown in U.S. Pat. Nos. 3,772,144 issued Nov. 13, 1973 and 4,827,741 issued May 9, 1989.

In spite of these improvements, the physical operation of the screen and the formation of a fiber batting on its outside surface, as the stock is withdrawn from the vat, has remained substantially unchanged. A particular characteristic which limits the effectiveness of the washing or dewatering, as the case may be, resides in the fact that the mat itself quickly forms on the wire and thereafter tends to block further flow of the liquor or wash water through the mat. In other words, the screen surface becomes closed by the accumulation of fibers on its surface.

This phenomena was noted as early as 1930 when, in U.S. Pat. No. 1,746,708 issued Feb. 11, 1930, the following statement was made ". . . so far as I am aware, the pulp carrying water begins to flow through the wire immediately after it is submerged—so that the layer of pulp is fully formed on the surface of the wire within a few inches of the point where the wire passes below the surface of the pulp carrying water. Consequently the layer of pulp which is formed on any portion of the wire is carried thereon throughout nearly the whole of its travel while submerged, regardless of the direction in which the wire moves with relation to the direction of the flow of the pulp in the vat."

The actual extent of matting of the paper fibers onto the surface of the wire, and the extent to which the wire then becomes closed to further dewatering varies with the character and freeness of the pulp itself. In almost every case, the effectiveness of dewatering and/or washing becomes substantially impaired throughout a major portion of the peripheral extent of rotation or movement of the screen by reason of the early forming of the fiber mat.

SUMMARY OF THE INVENTION

The invention is directed to method and apparatus by which the efficiency of a gravity-type thickener or washer may be substantially improved at relatively low expense, thereby increasing the effective capacity of such apparatus to thicken, or remove contaminants, or both. The concepts of this invention may be retrofitted to existing washers and deckers with advantage.

The invention includes the temporary break-up and disruption of the newly formed mat, at least at one, and preferably at a plurality of peripheral locations circumferentially of the cylinder, thereby opening the wire and allowing the mat to be reformed. Thus, instead of forming a mat once and thereafter effectively shutting off the flow therethrough, the mat is broken up and reformed a plurality of times, each time permitting further washing and/or dewatering to take place by flow of the liquor or white water from the vat into the interior of the cylinder. By the expedient of breaking up the fiber mat after it is formed, the screen surface is freed for further washing and dewatering until the mat reforms itself. In the preferred embodiment, it is broken or disturbed a second and a third time before the mat of fibers is allowed to form and exit the vat for conventional removal.

The break-up may be accomplished by a number of convenient mechanism, including water jets, rotating non-circular and non-contacting devices or stationary devices which induce a temporary suction or flow reversal at the wire surface. Alternatively, contacting brushes such as brushes or doctor blades may be employed in the vat, but non-contacting devices are preferred to reduce the rate of wear on the surface of the wire. More than one such device is preferably used at discrete peripheral locations so that there are successively a formation, breakup, reformation, re-breakup, and formation of the mat.

During the original formation of the fiber mat and following its subsequent break-ups, peripheral portions of the wire are open for the throughflow of washing liquid, contaminated cooking liquors or other liquids or water thereby increasing vat consistency, and increasing water and contaminant removal. Since it is an object of such thickeners or washers to remove a formed layer of fibers from the wire, a forming zone defined as the last one-third or so of the cylinder under the liquid level is allowed to be undisturbed, providing for the final recollection and formation of the fiber mat for delivery by the screen to the removal apparatus.

The invention may be described as a cylinder type paper pulp washer or thickener apparatus in which a rotatable cylinder mold has a forming wire outer surface and rotates at least partially submerged in a vat of dilute paper pulp stock in which a differential pressure is applied to the cylinder mold to draw stock from the vat through the cylinder mold and thereby form a pulp mat on the wire surface as the cylinder mold rotates about an axis of rotation in the vat. The pulp mat which forms on the wire surface is removed from this surface or from the cylinder mold at a pulp take-off position. The invention is characterized by the improvement in means and method by which the cylinder wire surface is caused to shed lose its fiber mat temporarily at a finite distance under the liquid level in the vat in the direction of cylinder rotation. This distance is at a position in which the pulp mat has formed on the wire and begins to obstruct the flow of stock through the wire surface, and the apparatus and method of the invention is operable to disrupt this mat and thereby re-establish the stock flow through the cylinder mold and provide for or permit the reformation of the fiber mat on the surface.

In one form, non-contacting devices are positioned in effective relation to the cylinder mold surface, which non-contacting devices may have irregular surfaces extending transversely of the cylinder mold, and are moved or rotated to cause a momentary flow impulse or reversal at the wire surface, therefore disrupting the formation of the mat.

In another aspect of the invention, the disrupting means may simply consist of a doctor blade, a brush, or the like positioned in engagement with the wire surface to doctor the mat off of the surface. In a further embodiment, a non-moving foil member has a curved foil or impulse-inducing surface positioned in close proximity to the moving surface of the wire, thereby creating a flow disturbance at the wire surface which is effective to disrupt or destroy the formation of the fiber mat temporarily. Alternatively, fluid water or air jets may be directed at the surface from a position outside of or inside of the cylinder mold.

It is accordingly an important object of this invention to provide an improved cylinder type paper pulp washer or thickener having means for breaking up or removing the mat of pulp formed on the wire for the purpose of re-establishing maximum flow of liquid through the cylinder screen to improve the efficiency of the washing or thickening operation.

A more particular object of the invention is the provision of apparatus, in a cylinder-type washer or thickener, in which a cylinder mold is at least partially submerged in a vat of dilute paper pulp, for causing a momentary disruption of the formation of a mat of paper fibers. The disrupter may be a stationary or moving object positioned in close proximity to the forming surface, a doctor blade or a water or air jet.

A further object of the invention is the provision of a method of operating or improving the operation of a cylinder-type paper pulp washer or thickener in which a cylinder mold rotates at least partially submerged in a vat of dilute paper pulp including the steps of permitting the formation of a mat of fibers on the cylinder mold and thereafter dislodging the newly formed mat of fibers so that the fiber mat reforms at least a second time.

These and other objects and advantages of the invention will be apparent from the following description, the accompanying drawings and the appended claims.

BRIEF DESCRIPTION OF ACCOMPANYING DRAWINGS

DESCRIPTION OF PREFERRED EMBODIMENTS

Figure 1:
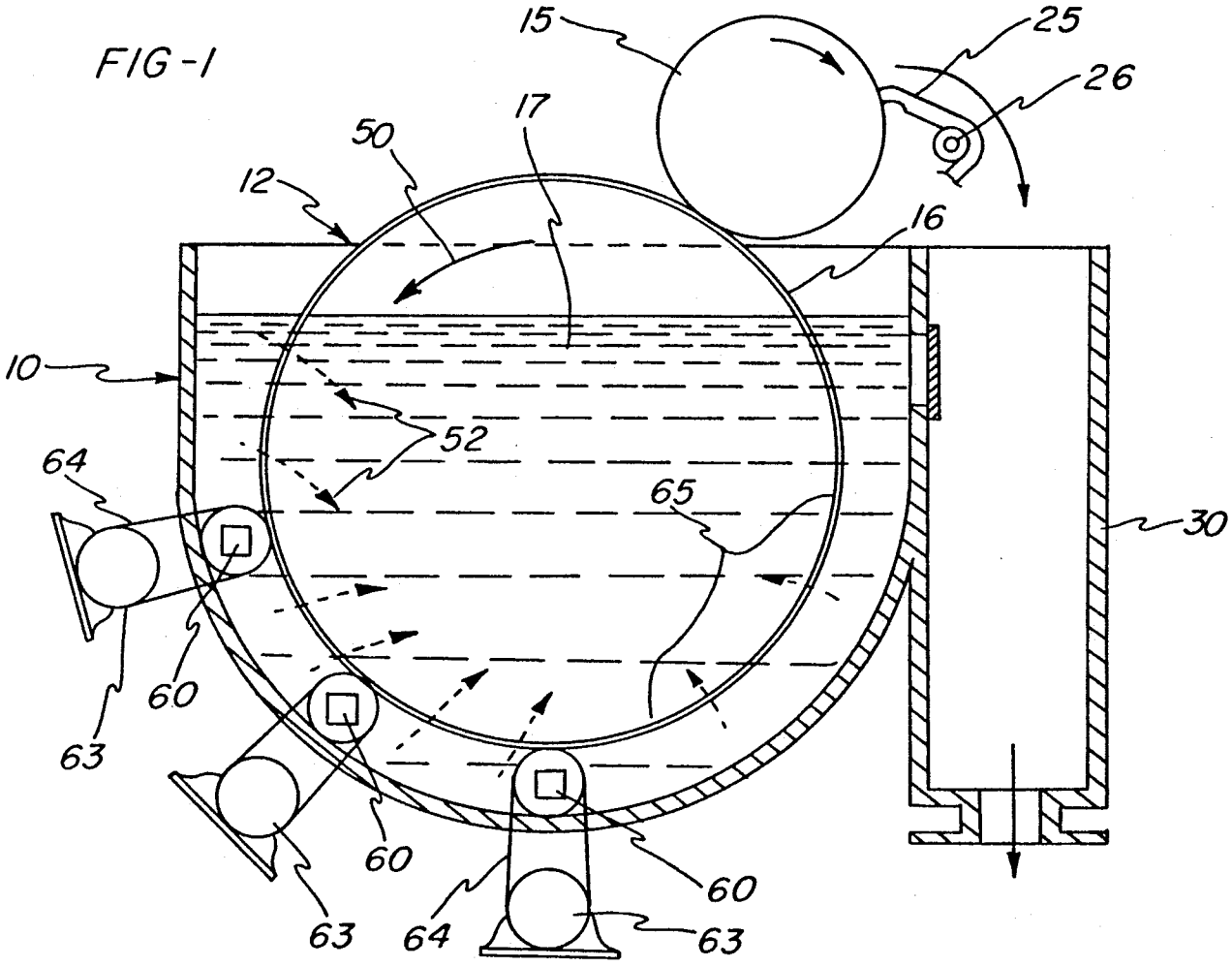
FIG. 1 is a diagram of a washer or thickener in accordance with this invention in which a plurality of transversely extending disrupters knock the formed mat off the cylinder mold.

A cylinder type paper pulp washer or thickener apparatus is illustrated generally at FIG. 1 as including a vat 10, a wire covered cylinder mold 12 rotating partially submerged in the vat 10 and a pick-off or couch roll 15 operating in running engagement with the surface of the wire or foraminous carriage 16 of the mold 12 in a pick-off position above the vat 10. The pick-off or couch roll is positioned above the level 17 of dilute papermaking stock in the vat 10. The general apparatus as illustrated in FIG. 1 is typical and understood as not restricting the scope of the invention, For the purpose of simplicity of illustration, a thickening apparatus of the general kind shown in Gibson, U.S. Pat. No. 2,669,909 issued Feb. 23, 1954, is employed. It will be understood, however, that the concepts and principles of the invention may be applied to improve the washing efficiency of more recent cylinder mold type washers of the airtight vat kind as shown, for example, in Luthi, U.S. Pat. No. 4,827,741, previously mentioned.

It is understood that the decker type of washer shown in FIG. 1 includes an inlet flow trough, not shown, for providing a dilute solution of papermaking stock to the vat 10 to the level 17. The couch roll 15 is mounted above the cylinder mold 12 and in driven contact to form a nip with the mold. A doctor blade 25 is pivoted at 26, and is positioned above a discharge trough 30. The blade 25 runs in contact with the surface of the couch roll 15 and receives the thickened pulp from the couch roll and discharges it down and into the trough 30.

As previously stated, a stock level 17 is maintained, and the cylinder mold 12 is rotated in the direction of the arrow 50. A lower pressure is maintained within the interior of the cylinder mold than the pressure maintained within the vat 10, so that the flow of white water from the dilute paper pulp is as shown by the arrows 52 through the outer wire surface of the cylinder 12 and into the interior. Within a few inches of the surface of the stock level 17, a fiber mat will begin to form on the wire surface 16 of the cylinder mold 12. This mat will, unless removed, build up and effectively obstruct the flow of stock from the vat into the interior of the cylinder mold while the thickness of the mat will not substantially increase once the same has formed.

Therefore, in accordance with this invention, the efficiency of the apparatus as a washer or thickener can be substantially improved by providing means for disrupting the initially formed mat at a discrete location or position which is a finite distance under the liquid level 17 in the direction of cylinder rotation 50. Preferably the disruption of the mat at the wire surface tends to lift the paper fibers clear and off the wire, thus providing for the re-establishment of flow of the liquid portion of the stock through the wire. Such disruption may take place at more than one peripheral position within the vat while assuring that a final mat will be formed on the cylinder for subsequent removal, as previously described.

Figure 2:
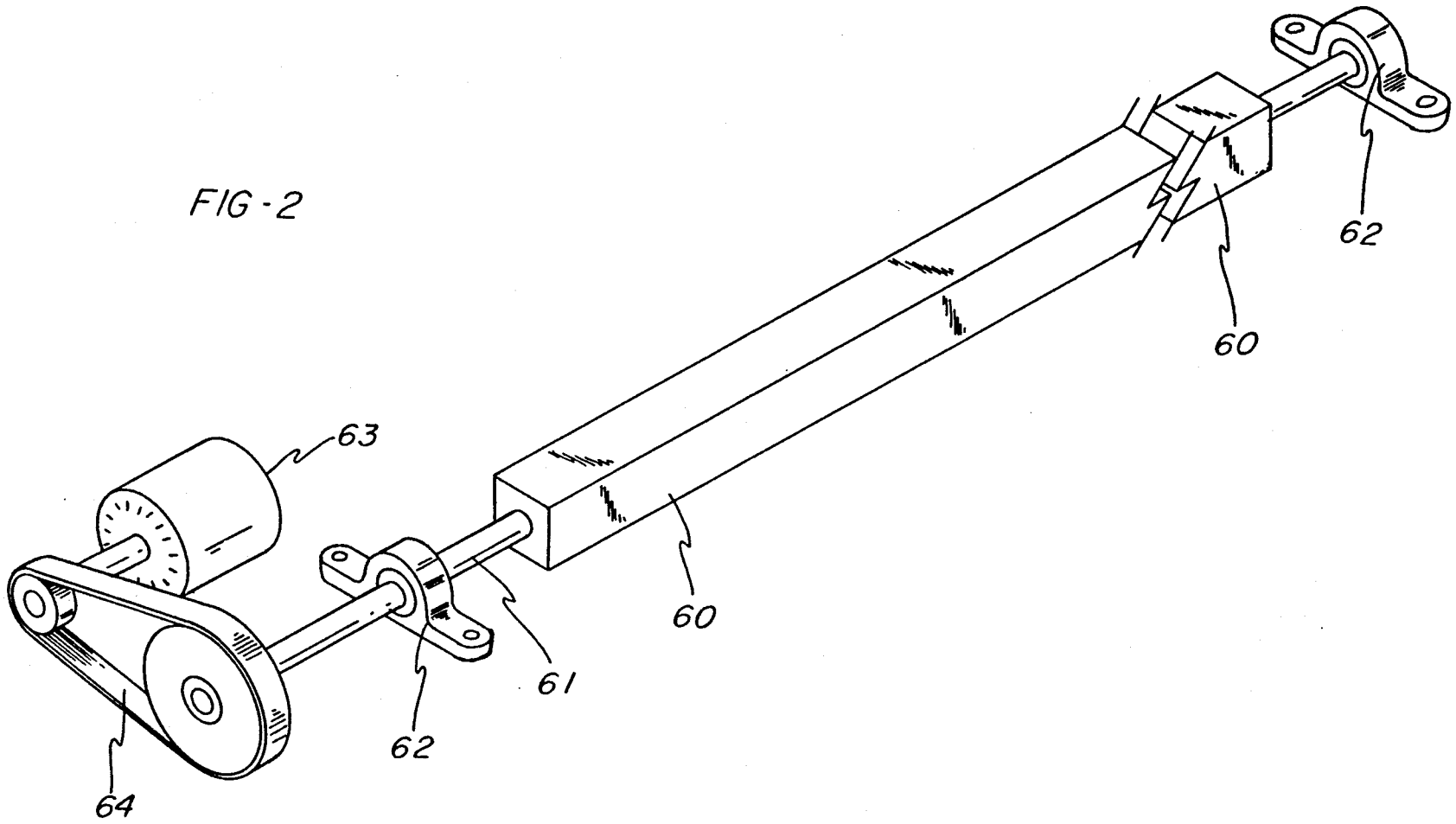
FIG. 2 is a perspective view of a rotating fiber mat disrupter as used in the apparatus of FIG. 1.

Preferably, non-contacting disrupters are used, such as transversely extending (parallel to the cylinder axis) rotating or non-rotating devices which operate close to but not necessarily in physical contact with the surface of the screen itself, so as not to damage or impair the life of the screen. A preferred form of a non-contacting disrupter consists of a non-circularly shaped rotating bar, such as the square bar 60 (FIG. 2), positioned on a support bar or rail 61 in transverse relation to the screen, and mounted on bearings 62 at the opposite ends, and rotated by a motor drive 63 by a belt 64. The rotation of the disrupter 60, which may be clockwise as viewed in FIG. 1, provides impulses to the immediate adjacent surface of the wire so that temporary flow reversal occurs, between the corners of the bar 60 and the wire, so that the newly formed mat is broken up and allowed to reform. A plurality of the disrupter bars 60 are shown, in peripherally spaced locations within the vat 10. A final forming zone 65 is provided between the last of the disrupters 60, in the direction of rotation and the stock level 17, so that a mat of paper pulp fibers may be formed on the cylinder mold and removed by the couch roll 15. The zone 65 may extend above the final one-third of the cylinder mold under the level 17.

In a typical cylinder mold pulp washer or thickener the fiber mat has been observed to form within approximately six inches of the stock level 17, and the first disrupter 60 may therefore be positioned its finite distance beneath the level 17 by approximately six inches below the level. Further, it is not necessary to the practice of this invention to use the same disrupter at each of the several peripheral locations illustrated, and a water or air jet may be used in one location, and a doctor blade or a non-moving or rotating device may be used in one of the other locations, as long as the same are effective to dislodge or break up the formed fiber mat, thereby re-establishing flow of stock through the mold.

Figure 3:
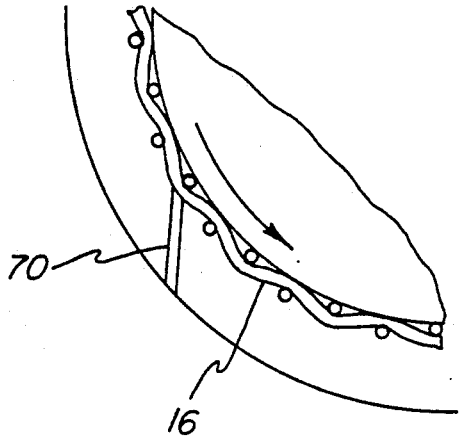
FIG. 3 is a diagram of a disrupter in the form of a doctor blade.
Figure 4:
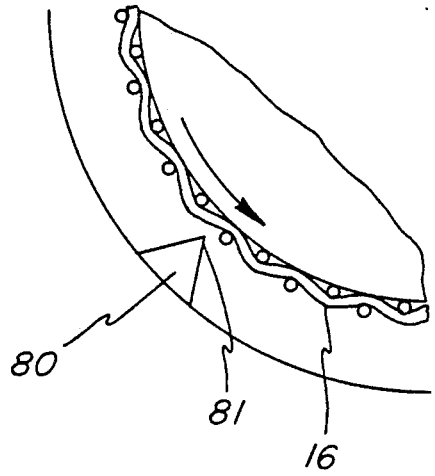
FIG. 4 is a diagram of a disrupter in the form of an obstruction.

FIGS. 3–7 diagrammatically illustrate additional preferred forms which the disrupter may take. In FIG. 3, a conventional doctor blade 70 is shown, which may be a foil or an elastomer, which engages the surface of the wire. In FIG. 4, a disrupter is shown in the form of a protuberance 80, triangular in end view or cross section, which extends from an inside surface of the vat 10 and terminates at an apex 81 in close but non-contacting relation to the surface of the wire which, when the mold is rotating, will form a pressure region on one side and a suction region on the other, tending to dislodge the fibers.

Figure 5:
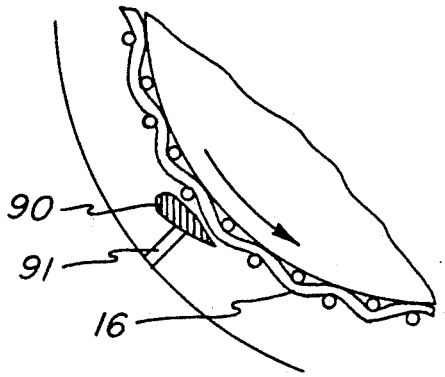
FIG. 5 is a diagram of a disrupter in the form of an impulse foil.

FIG. 5 illustrates a non-rotating and non-moving foil member 90 mounted on a support 91. The foil member 90, in cross section, may have an airfoil shape which will create a suction side along the trailing edge adjacent the wire surface 16. In this connection, the pulsating action formed by the foil in connection with the rotating cylinder mold is not unlike the pulsating action caused by the rotating foils illustrated in the cylinder screening apparatus of Martindale, U.S. Pat. No. 2,835,173 issued May 20, 1958. The member 90 may be formed as shown in the U.S. Pat. of Chupka et al, No. 4,919,797 issued Mar. 24, 1990.

Figure 6:
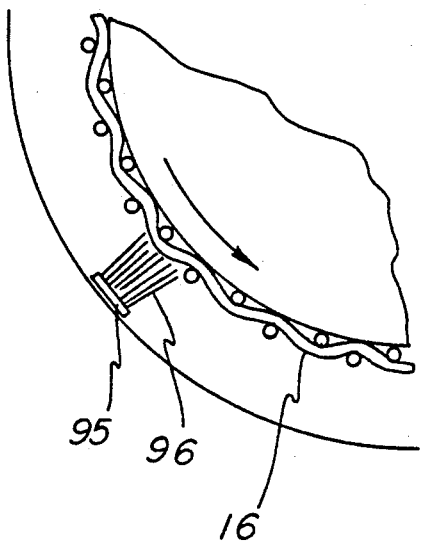
FIG. 6 is a diagram of a disrupter in the form of a brush.

FIG. 6 illustrates a disrupter in the form of a brush 95 which has mounted on the inside surface of the vat 10, with bristles 96 extending toward the adjacent surface of the wire 16 so that the bristles 96 will engage and disrupt a fiber mat as it has been formed on the cylinder mold.

Figure 7:
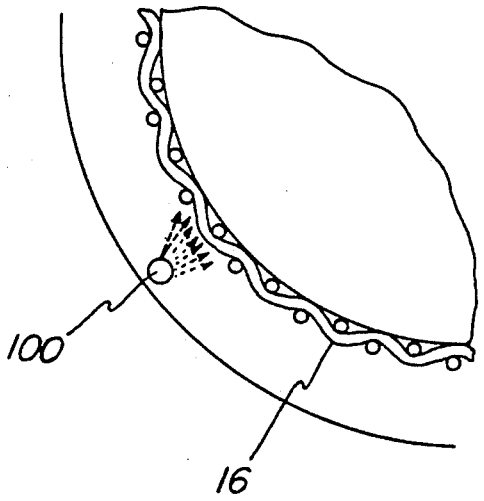
FIG. 7 is a diagram of a disrupter in the form of a fluid jet as shown.

FIG. 7 illustrates the use of a fluid jet 100, in this case, positioned within the vat external of the cylinder mold and directed against the extraction wire surface. The jet 100 is preferably a water jet although air under pressure could also be used. In other embodiments, a fluid jet 100 may be positioned within the interior of the cylinder mold and directed outwardly through the wire.

The operation of the invention is believed to be largely self-evident from the foregoing description. In FIG. 1 it will be seen that the disrupters bars 60 are positioned in peripherally spaced relation, three being illustrated at substantially the 160°, 200° and 240° radial position from the axis of the cylinder mold when viewed from the end. In the case of the non-circular disrupter bar 60, it is rotated by the motors 63 to cause or create a pulsating condition which will disrupt the fiber mat and permit it to reform in the space between the disrupters, and finally in the final reformation zone 65 for removal by the couch roll 15, the doctor blade 25, and the trough 30. The washer or thickener made according to this invention therefore has a greater capacity for thickening and/or washing, as compared to conventional cylinder mold type washers which do not have any means for providing a continued flow of stock through the cylinder mold after the pulp mat forms in the first few inches of travel under the stock level. The disrupter devices illustrated in FIGS. 3–7 may also be used, alone or in combination with the bar 60, at such discrete peripheral positions in relation to the submerged surface of the mold 12.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention, which is defined in the appended claims.

What is claimed is:

1. In a cylinder type paper pulp washer or thickener apparatus in which a rotatable cylinder mold has a forming wire surface, means for rotating said mold, said mold being at least partially submerged in a vat of dilute paper pulp stock, means for applying a differential pressure across the wire surface to cause stock in the vat to flow through the cylinder mold and form a pulp fiber mat on the wire surface thereof as the cylinder mold rotates about an axis of rotation in the vat, and means for removing the pulp fiber mat which forms on the wire surface form the cylinder mold at a pulp take-off position, said removing means being structured and arranged to break up the mat and remove the mat in bulk, the improvement comprising:

disrupter means in said vat located outside said cylinder mold including a plurality of arcuately placed fiber mat disrupters positioned adjacent said cylinder wire surface and effective a finite distance under the liquid level in said vat in the direction of cylinder rotation at positions in which the pulp mat forming on the wire surface begins to obstruct the flow of stock through said wire surface, said disrupters structured and arranged to dislodge said mat from said wire surface thereby providing for re-establishment of said flow and providing for the reformation of such fiber mat on the portion of said forming wire surface between said disrupters and said pulp take-off position, said disrupters further comprising impulse devices positioned in said vat having impulse surfaces positioned in close and non-contacting relation to said wire surface, and means for rotating said impulse devices relative to said wire surface concurrently with the rotation of said cylinder mold to cause momentary flow impulses at said wire surfaces for disrupting the formation of a mat and causing said mat to be dislodged from said wire surface.

* * * * *